US010835934B2

(12) United States Patent
Padgett

(10) Patent No.: US 10,835,934 B2
(45) Date of Patent: Nov. 17, 2020

(54) PRESSURE CHEMICAL CONTROL APPARATUS

(71) Applicant: James Padgett, Franklinton, NC (US)

(72) Inventor: James Padgett, Franklinton, NC (US)

( * ) Notice: Subject to any disclaimer, the term of this patent is extended or adjusted under 35 U.S.C. 154(b) by 0 days.

(21) Appl. No.: 16/025,978

(22) Filed: Jul. 2, 2018

(65) Prior Publication Data

US 2019/0001377 A1 Jan. 3, 2019

Related U.S. Application Data

(60) Provisional application No. 62/527,100, filed on Jun. 30, 2017.

(51) Int. Cl.

| | |
|---|---|
| ***B08B 3/02*** | (2006.01) |
| ***B08B 3/08*** | (2006.01) |
| ***B05B 1/16*** | (2006.01) |
| ***B05B 12/14*** | (2006.01) |
| ***B05B 7/04*** | (2006.01) |

(52) U.S. Cl.

CPC ..... *B08B 3/026* (2013.01); *B05B 1/16* (2013.01); *B05B 7/0408* (2013.01); *B05B 12/1409* (2013.01); *B08B 3/028* (2013.01); *B08B 3/08* (2013.01); *B08B 2203/02* (2013.01); *B08B 2203/0217* (2013.01)

(58) Field of Classification Search

None

See application file for complete search history.

(56) References Cited

U.S. PATENT DOCUMENTS 3,850,371 A * 11/1974 Trapp ..... B05B 7/0408 239/113

4,296,317 A * 10/1981 Kraus ..... B05B 13/005 250/215

* cited by examiner

*Primary Examiner* — Eric W Golightly

(74) *Attorney, Agent, or Firm* — Albert J. Minn; Grell & Watson Patent Attorneys LLC

(57) ABSTRACT

A wand apparatus for controlling a pressure washing system and an associated method for controlling a pressure washing system is provided. The wand apparatus may include a first wand portion and a second wand portion. The wand apparatus may further include a chemical control assembly that includes a housing and a chemical control element. The housing defines an outlet aperture, an inlet aperture, and a chemical control aperture. The chemical control aperture is configured to operably engage the chemical control element. The outlet aperture is configured to operably engage the first wand portion, and the inlet aperture is configured to operably engage the second wand portion. Further, operable engagement of the chemical control element may provide for switching the wand apparatus between a chemical spray configuration and a wash spray configuration.

10 Claims, 6 Drawing Sheets

PRESSURE CHEMICAL CONTROL APPARATUS

CROSS-REFERENCE TO RELATED APPLICATION(S)

To the full extent permitted by law, the present United States Non-provisional Patent Application hereby claims priority to and the full benefit of U.S. Provisional Patent Application No. 62/527,100, filed Jun. 30, 2017, the disclosure of which is each incorporated herein by reference in their entirety.

BACKGROUND

Field of the Disclosure

The present disclosure relates generally to a device for controlling chemical flow through a wand apparatus of a pressure washing system, and more specifically, to a device for controlling the flow of a chemical cleaner and/or water through the wand apparatus of the pressure washing system.

Description of Related Art

Currently, many commercial pressure washing systems are disposed on trucks where pressure hoses that are hundreds of feet in length are disposed on reels. Users must walk around the structure with the hose trailing behind them as they wet the structure, apply a chemical cleaning solution, and/or rinse the structure of the chemical cleaning solution with a wand or spray gun device. Some chemical cleaning solutions can be detrimental to vegetation surrounding the structure, the paint disposed on the structure, or the structure itself if the chemical cleaning solution is allowed to dry. Further, some previous devices have changed a spray selection by changing the fluid pressure exiting the wand or spray gun device. Usually, when cleaning a rear of a structure far away from the fluid tanks that hold the water and/or chemical cleaning solutions, one must travel back to the truck to switch the fluid flow between the water and the cleaning solution. The time spent traveling from a particular location proximate the rear of the structure back to the truck and back to the previous location causes inefficiency, possibility of structural damage or damage to surrounding plants. As such, a need exists to provide for changing the fluid flow between a wash spray (e.g., water) and a chemical cleaning solution quickly and efficiently. Another need includes providing for a change in fluid flow between a wash spray (e.g., water) and a chemical cleaning solution while maintaining a constant fluid pressure for the fluid exiting the wand.

BRIEF SUMMARY

Example implementations of the present disclosure are directed toward a wand apparatus of a pressure device for controlling the application of a chemical cleaner. The wand apparatus includes a first wand portion and a second wand portion. Additionally, the wand apparatus may include a chemical control assembly. The chemical control assembly includes a housing and a chemical control element. The housing may define an outlet aperture, an inlet aperture, and a chemical control aperture. The chemical control aperture may be configured to operably engage the chemical control element. The outlet aperture may be configured to operably engage the first wand portion, and the inlet aperture may be configured to operably engage the second wand portion.

Further, operable engagement of the chemical control element provides for switching the wand apparatus between a chemical spray configuration and a wash spray configuration.

According to some aspects, the first wand portion may define a first fluid channel that extends throughout the first wand portion. Further, the second wand portion may define a second fluid channel that extends throughout the second wand portion. The first fluid channel may also be configured to be in fluid communication with the outlet aperture of the chemical control assembly, and the second fluid channel may be configured to be in fluid communication with the inlet aperture of the chemical control assembly.

In some aspects, the wand apparatus may further comprise a stabilizing grip handle. The stabilizing grip handle may extend along a plane that is orthogonal to the wand apparatus. Additionally, the chemical control element may extend longitudinally from the stabilizing grip handle. According to some aspects of the present disclosure, the stabilizing grip handle may be configured to rotate about a central axis that extends longitudinally along the stabilizing grip handle.

In yet another aspect, the housing of the chemical control assembly may further define an outlet chamber, an inlet chamber, and a chemical control chamber. Additionally or alternatively, the outlet chamber may be in fluid communication with the chemical control chamber, and the inlet chamber may be in fluid communication with the chemical control chamber. In some aspects, the inlet chamber, the outlet chamber, and the chemical control chamber may be in fluid communication with each other.

According to some aspects, the chemical control element may further include a control member. The control member may define a control aperture, a first flow aperture, and a second flow aperture. Additionally or alternatively, the housing of the chemical control element may further define an intermediate flow chamber disposed proximate the inlet chamber and the chemical control chamber of the housing. In some aspects, the intermediate flow chamber may be in fluid communication with the inlet chamber and/or the chemical control chamber. In some aspects of the present disclosure, a diameter of the intermediate flow chamber may be greater than a diameter of the control aperture of the control member of the chemical control element. Additionally or alternatively, the stabilizing grip handle may be configured such that rotation of the stabilizing grip handle causes the control member to operably engage the intermediary flow aperture defined by the housing of the chemical control element. According to some aspects, the wand apparatus may further include a trigger assembly configured to provide for a fluid flow between the inlet aperture and the outlet aperture of the chemical control assembly.

In yet another aspect of the present disclosure, a method of cleaning a structure with a wand apparatus of a pressure washing system may be provided. The method may include starting a pressure washing system that includes a wand apparatus. The wand apparatus may include a first wand portion, a second wand portion, and a chemical control assembly. In some aspects, the chemical control assembly may include a housing and a chemical control element. Additionally, the housing may define an outlet aperture, an inlet aperture, and a chemical control aperture, and the chemical control aperture may be configured to operably engage the chemical control element. The outlet aperture may be configured to operably engage the first wand portion, and the inlet aperture may be configured to operably engage the second wand portion. Additionally or alternatively, the chemical control element may be configured such that operably engagement of the chemical control element may provide for switching the wand apparatus between a chemical spray configuration and a wash spray configuration. Further, the method may include spraying the structure with a wash spray with the wand apparatus. In some aspects, the method may include engaging the chemical control element to switch the wand apparatus from a wash spray configuration to a chemical spray configuration. Further, the method may include spraying the structure with a chemical spray with the wand apparatus. According to some aspects, the method may include engaging the chemical control element to switch the wand apparatus from a chemical spray configuration to a wash spray configuration. In yet another aspect of the present disclosure, the method may include rinsing the structure with a wash spray with the wand apparatus.

The features, functions and advantages discussed herein may be achieved independently in various example implementations or may be combined in yet other example implementations further details of which may be seen with reference to the following description and drawings.

BRIEF DESCRIPTION OF THE DRAWING(S)

Having thus described example implementations of the disclosure in general terms, reference will now be made to the accompanying drawings, which are not necessarily drawn to scale, and wherein:

Figure 1:
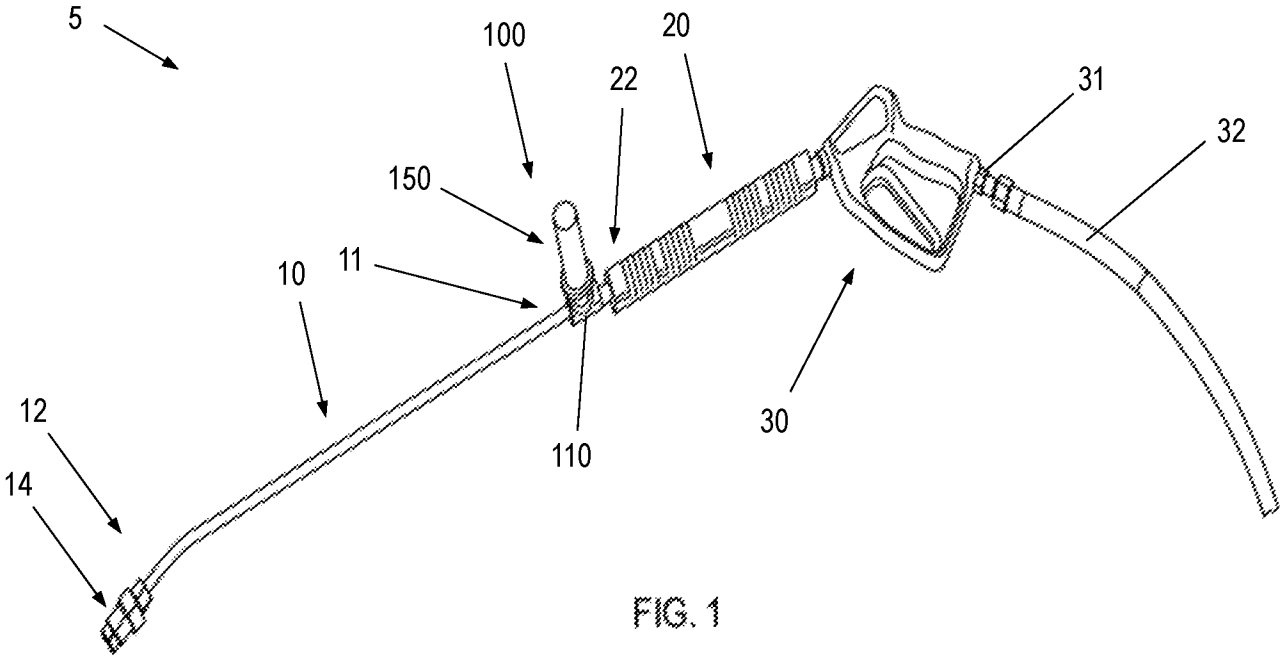
FIG. 1 illustrates a perspective view of a wand apparatus according to one example implementation of the present disclosure.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Some implementations of the present disclosure will now be described more fully hereinafter with reference to the accompanying drawings, in which some, but not all implementations of the disclosure are shown. Indeed, various implementations of the disclosure may be expressed in many different forms and should not be construed as limited to the implementations set forth herein; rather, these exemplary implementations are provided so that this disclosure will be thorough and complete, and will fully convey the scope of the disclosure to those skilled in the art. As used herein, the term "and/or" and the "/" symbol includes any and all combinations of one or more of the associated listed items. Further, unless otherwise indicated, something being described as being a first, second or the like should not be construed to imply a particular order. It should be understood that the terms first, second, etc. may be used herein to describe various steps, calculations, positions and/or the like, these steps, calculations or positions should not be limited to these terms. These terms are only used to distinguish one operation, calculation, or position from another. For example, a first position may be termed a second position, and, similarly, a second step may be termed a first step, without departing from the scope of this disclosure. Additionally, something may be described as being above something else (unless otherwise indicated) may instead be below, and vice versa; and similarly, something described as being to the left of something else may instead be to the right, and vice versa. As used in the specification, and in the appended claims, the singular forms "a", "an", "the", include plural referents unless the context clearly dictates otherwise. Like reference numerals refer to like elements throughout.

Implementations of the present disclosure provide for a wand apparatus for a pressure washing system. As shown in FIG. 1, a wand apparatus 5 for controlling a wash spray and/or a chemical spray may include a first wand portion 10 and a second wand portion 20. Additionally or alternatively, the wand apparatus may include a trigger assembly 30. The trigger assembly 30 may be configured to provide for fluid flow through the wand apparatus 5, as described herein. Additionally or alternatively, the trigger assembly 30 may include a hose connector 31 configured to operably engage an end of a hose 32 that is in fluid communication with the pressure washing system.

Figure 4:
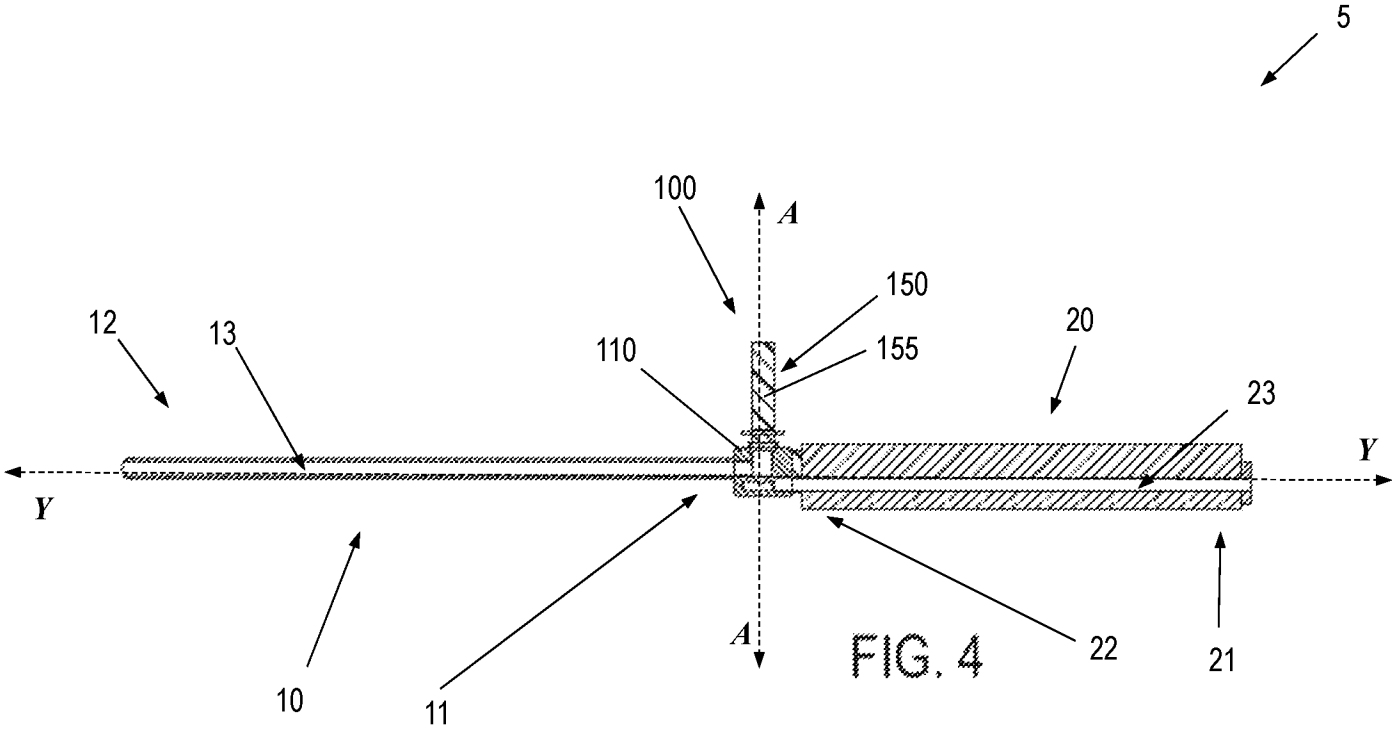
FIG. 4 illustrates a cross-sectional view of portions of a wand apparatus according to one example implementation of the present disclosure.

According to some aspects, the wand 5 may further include a chemical control assembly 100 disposed proximate the first wand portion 10 and the second wand portion 20. In particular, as shown in FIG. 1, the chemical control assembly 100 may be disposed proximate a first end 11 of the first wand portion 10. In some aspects, the chemical control assembly 100 may be disposed proximate a second end 22 of the second wand portion 20. Referring to FIG. 4, the first wand portion 10 may define a first fluid channel 13 that extends from the first end 11 to the longitudinally opposed second end 12 of the first wand portion 10. Likewise, the second wand portion 20 may define a second fluid channel 23 that extends from the first end 21 to the longitudinally opposed second end 22 of the second wand portion 20. Additionally, or alternatively, the trigger assembly 30 may be configured to provide for fluid flow through the first fluid channel 13 and/or the second fluid channel 23 when a trigger mechanism is engaged.

Figure 2:
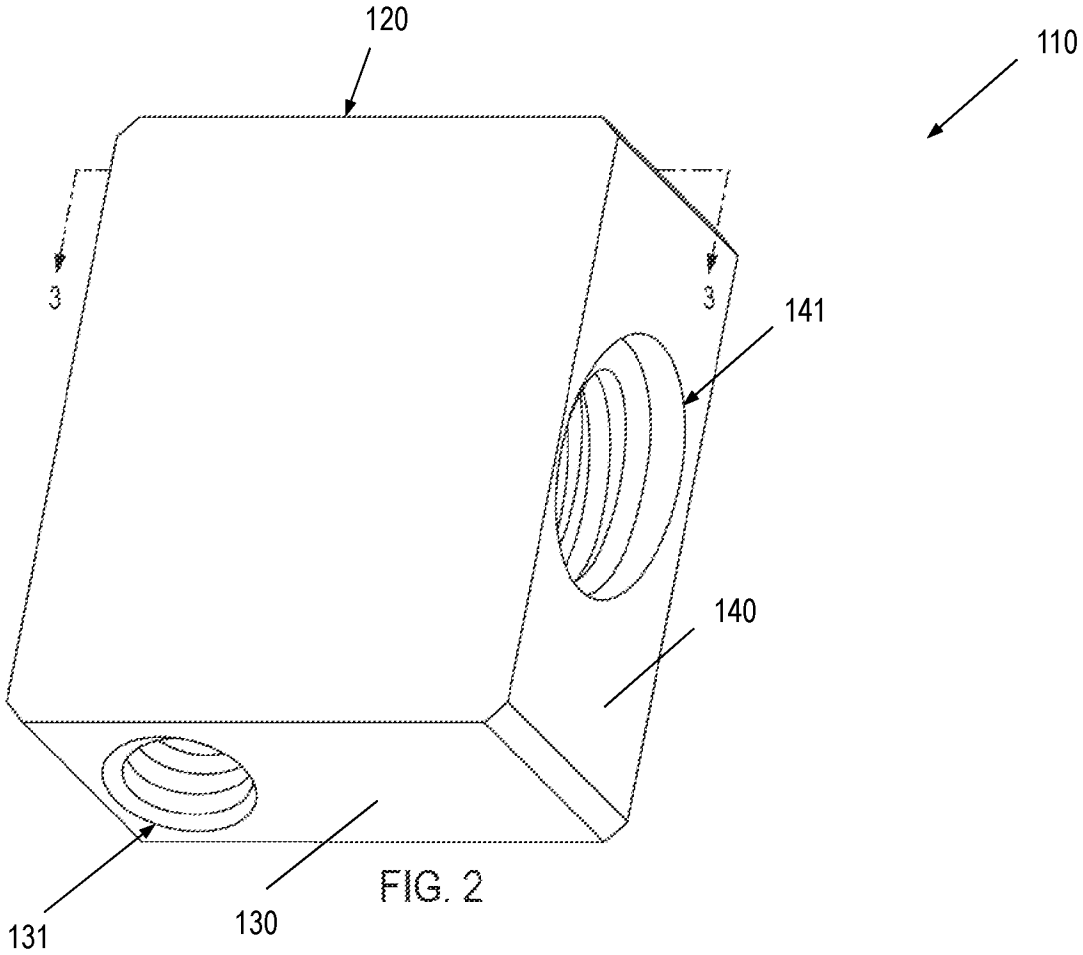
FIG. 2 illustrates a perspective view of a chemical control assembly housing according to one example implementation of the present disclosure.
Figure 3:
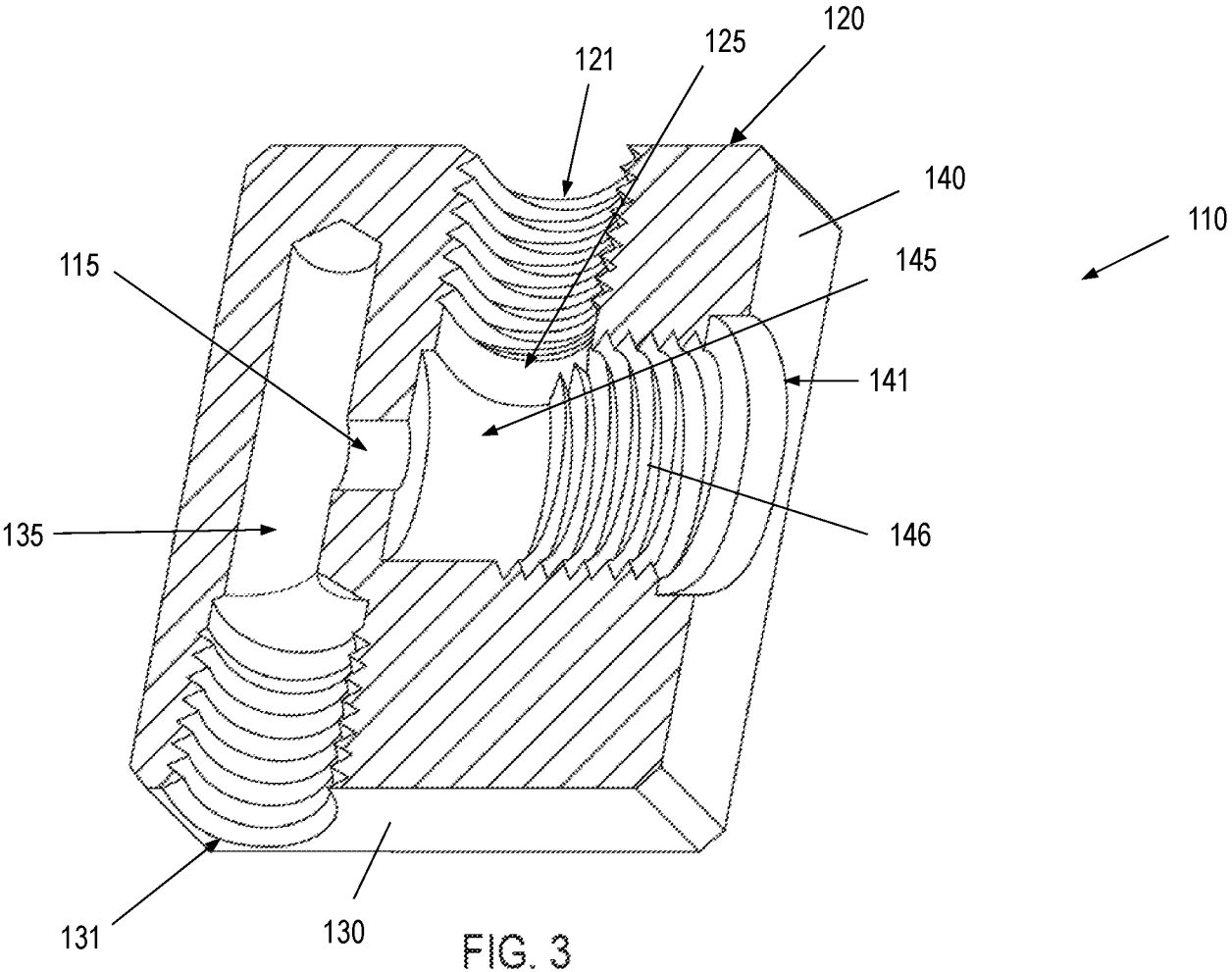
FIG. 3 illustrates a perspective view of a cross-sectional view of the chemical control assembly housing of FIG. 2 taken along line 3 according to one example implementation of the present disclosure.

As shown in FIGS. 1, 2, and 3, the chemical control assembly 100 may include a housing 110 that includes a front surface 120, a rear surface 130, and a chemical control surface 140. Additionally, the chemical control surface 140 may define a chemical control aperture 141. Further, the front surface 120 of the housing 110 may define an outlet aperture 121, and the rear surface 130 of the housing 110 may define an inlet aperture 131.

Referring to FIG. 3, the housing 110 may further define an inlet chamber 135. In some aspects, the inlet aperture 131 defined by the rear surface 130 of the housing 110 may be configured to provide access therethrough to the inlet chamber 135. Additionally or alternatively, the housing 110 may further define an outlet chamber 125. According to some aspects, the outlet aperture 121 defined by the front surface 120 of the housing 110 may be configured to provide access therethrough to the outlet chamber 125. Further, the housing 110 may define a chemical control chamber 145. The chemical control aperture 141 defined by the chemical control surface 140 of the housing 110 may be configured to provide access therethrough to the chemical control chamber 145.

As shown in FIG. 3, the outlet chamber 125 and the chemical control chamber 145 may be in fluid communication with one another. Further, the housing 110 may define an intermediate flow chamber 115 disposed proximate the inlet flow chamber 135 and/or the chemical control chamber 145. Additionally, the intermediate flow chamber 115 may be in fluid communication with the inlet flow chamber 135 and/or the chemical control chamber 145.

According to some aspects, the inlet aperture 131 defined by the rear surface 130 of the housing 110 may be configured to operably and/or reciprocally engage the second wand portion 20. In particular, the second end 22 of the second wand portion 20 may be configured to operably and/or reciprocally engage the inlet aperture 131 of the housing 110. For example, the second end 22 of the second wand portion 20 may be configured to engage the inlet aperture 131 of the housing 110 in a threaded engagement. Although aspects of the present disclosure illustrate the second end 22 of the second wand portion 20 being in a threaded engagement with the housing 110 of the chemical control assembly 100, other suitable engagement arrangements are also encompassed by this disclosure. As shown in FIG. 4, Additionally, the second fluid channel 23 of the second wand portion 20 may be in fluid communication with the inlet aperture 131 of the housing 110.

Referring to FIGS. 3 and 4, the outlet aperture 121 defined by the front surface 120 of the housing 110 of the chemical control assembly 100 may be configured to operably and/or reciprocally engage the first wand portion 10. In particular, the first end 11 of the first wand portion 10 may be configured to operably and/or reciprocally engage the outlet aperture 121 of the housing 110. As shown in FIG. 4, the first fluid channel 13 may be in fluid communication with the outlet aperture 121 of the housing 110. For example, the first end 11 of the first wand portion 10 may be configured to engage the outlet aperture 121 of the housing 110 in a threaded engagement.

In some aspects, the housing 110 may be configured to operably and/or reciprocally engage the chemical control element 150. As shown in FIG. 4, when the chemical control element 150 is operably engaged with the housing 110 of the chemical control assembly 100, the chemical control element 150 extends along an axis A that is orthogonal to a longitudinal axis Y of the wand apparatus.

Figure 5:
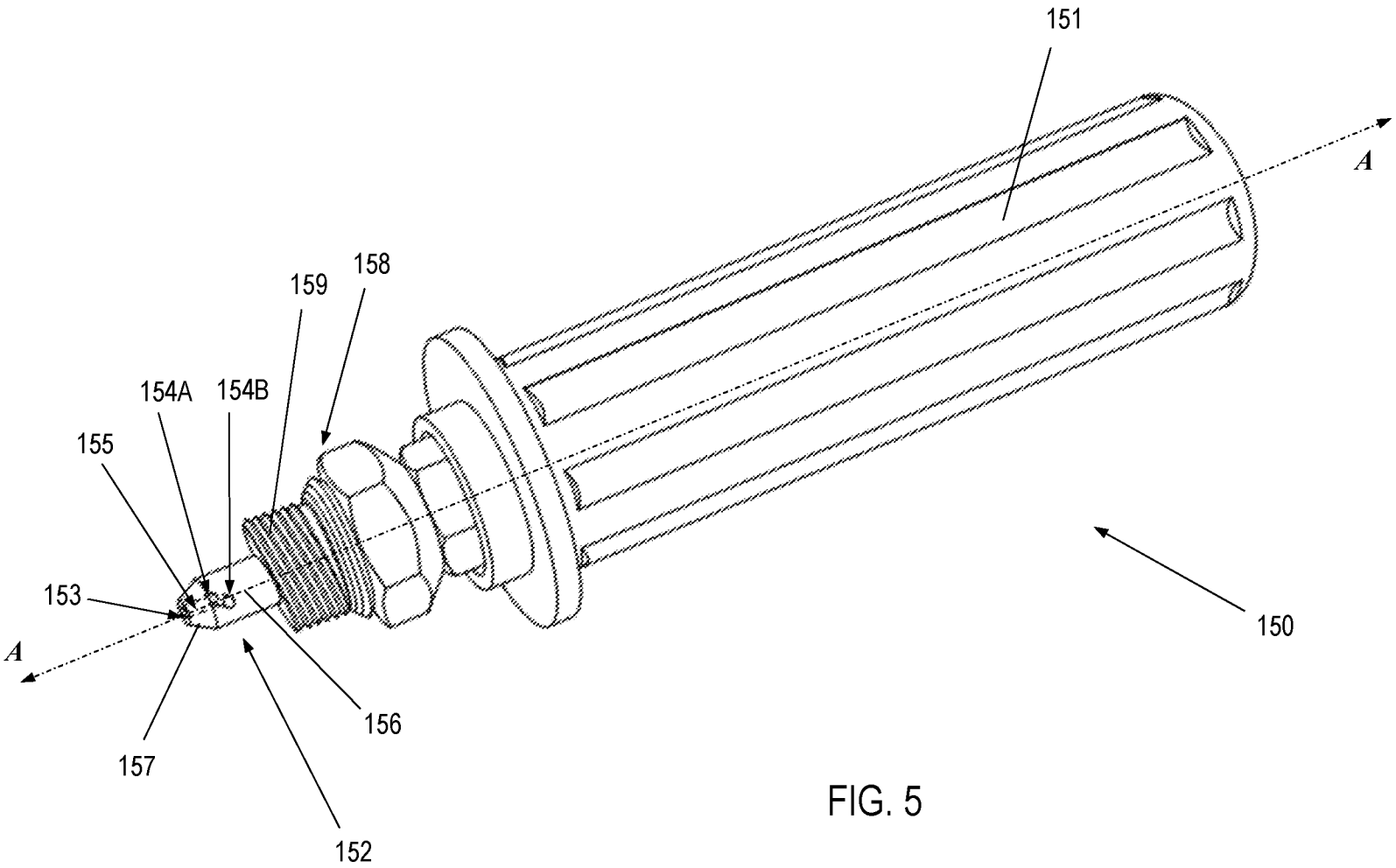
FIG. 5 illustrates a perspective view of a chemical control element of a wand apparatus according to one example implementation of the present disclosure.

Referring to FIGS. 1, 2 and 3, the chemical control surface 140 of the housing 110 may define a chemical control aperture 141 configured to operably and/or reciprocally engage a chemical control element 150. As shown in FIGS. 3 and 5, the chemical control chamber 145 may further define a threaded surface 146 configured to reciprocally engage a threaded surface 159 of an attaching member 158 of the chemical control element 150. Additionally or alternatively, the chemical control chamber 145 and the chemical control element 150 may be configured to operably engage one another to create a seal that prevents fluid flow through the chemical control aperture 141. In some aspects, the threaded surface 159 of the attaching member 158 of the chemical control element 150 may be configured to securely engage the chemical control element 150 with the housing 110 of the chemical control assembly 100. According to another aspect, the attaching member 158 may be integrally formed with the housing 110.

As shown in FIGS. 1 and 5, the chemical control element 150 may further include a stabilizing grip handle 151. Additionally or alternatively, the chemical control element 150 may also include a pressure control member 152. In some aspects, the pressure control member 152 may define a control aperture 153 disposed proximate a distal end of the pressure control member 152. Additionally, the pressure control member 152 may define at least one flow aperture. As shown in FIG. 5, the pressure control member 152 may define a first flow aperture 154A and a second flow aperture 154B. According to some aspects, the pressure control member 152 may further define a pressure control channel 155 that extends from the control aperture 153 to at least one of the first and/or second flow apertures 154A, 154B. The pressure control channel 155 may provide for fluid communication between any of the control aperture 153, the first flow aperture 154A, and/or the second flow aperture 154B. In some aspects, the pressure control channel 155 may be shaped as a T-junction so as to create a turbulent flow therethrough.

According to one aspect, the pressure control member 152 may include a cylindrical portion 156 and a tapered portion 157. As shown in FIG. 5, the pressure control member 152 may extend longitudinally from and/or coaxially with the stabilizing grip handle 151. In particular, the stabilizing grip handle 151 and the pressure control member 152 may extend longitudinally along the axis A. Additionally, the pressure control member 152 may extend from the stabilizing grip handle 151 from the cylindrical portion 156 to the tapered portion 157. In some aspects, the tapered portion may define the control aperture 153. Further, the longitudinal axis A of the chemical control element 150 may extend through the center of the control aperture 153. According to some aspects, the cylindrical portion 156 of the pressure control member 152 may define the at least first and second flow apertures 154A, 154B.

According to some aspects, the stabilizing grip handle 151 may be operably and/or securely engaged with the pressure control member 152. In another aspect, the stabilizing grip handle 151 may be integrally formed with the pressure control member 152. Referring to FIG. 5, the stabilizing grip handle 151 may be configured to rotate about the longitudinal axis A extending through the chemical control element 150. Accordingly, rotation of the stabilizing grip handle 151 may cause the pressure control member 152 to rotate about the longitudinal axis A at a similar rate. Additionally or alternatively, rotation of the stabilizing grip handle 151 may cause the pressure control member 152 to travel longitudinally along the longitudinal axis A of the chemical control element 150.

Additionally, the stabilizing grip handle 151 may be operably engaged with the attaching member 158 of the chemical control element 150. According to some aspects, the attaching member 158 may be configured to operably and/or reciprocally engage the stabilizing grip handle 151 such that the stabilizing grip handle 151 may rotate with respect to the attaching member 158. For example, the stabilizing grip handle 151 may be configured to engage the attaching member 158 in a threaded engagement such that rotation of the stabilizing grip handle 151 may cause the stabilizing grip handle 151 and/or the pressure control member 152 to rotate with respect to the attaching member 158. Further, rotation of the stabilizing grip handle 151 with respect to the attaching member 158 may cause the pressure control member 152 to move longitudinally along the axis A.

In some aspects, when the chemical control element 150 is operably engaged with the chemical control chamber 145 defined by the housing 110 of the chemical control assembly 100, the longitudinal axis A of the chemical control element may be colinear with a central axis of the chemical control chamber 145. Additionally or alternatively, the pressure control member 152 may be configured to move longitudinally within the chemical control chamber 145 towards and/or away from the intermediate chamber 115 of the housing 110. In some aspects, the diameter of the intermediate chamber 115 is greater than the diameter of the control aperture 153 defined by the pressure control member 152 of the chemical control element 150. Additionally, the diameter of the cylindrical portion 156 of the pressure control member 152 may be greater than the diameter of the intermediate chamber 115 defined by the housing 110. As such, when rotation of the stabilizing grip handle 151 causes the pressure control member 152 to move longitudinally within the chemical control chamber 145 towards the intermediate chamber 115, the smaller diameter of the intermediate chamber 115 will prevent the insertion of the larger diameter of the cylindrical portion 156 of the pressure control member 152 therethrough. In some aspects, rotation of the stabilizing grip handle 151 may cause the tapered surface 157 to operably engage the intermediate chamber 115 and/or create a seal therebetween.

According to some aspects, the chemical control element 150 may be configured to switch the wand apparatus between a chemical spray configuration and a wash spray configuration. In a wash spray configuration, the wand apparatus may be configured to provide for the fluid flow of water through the wand apparatus, and more particularly through a wand outlet 14 disposed proximate the second end 12 of the first wand portion 10. When the wand apparatus 5 is disposed in a chemical spray configuration, the chemical control element 150 may provide for the fluid flow of a chemical cleaning solution through the wand apparatus, and more particularly through the wand outlet 14. Additionally or alternatively, the wand apparatus 5 may be configured to provide for the fluid flow of a liquid through the wand outlet 14 at a pressure between 100-3000 pounds per square inch. In some embodiments, the wand apparatus 5 may be configured to provide for the fluid flow of a liquid through the wand outlet 14 at a pressure between 100-500 pounds per square inch, and more preferably between 100-300 pounds per square inch. Further, the wand apparatus 5 may be configured to provide for a fluid flow of a liquid through the wand outlet 14 at a substantially similar pressure when the wand apparatus 5 is disposed in a chemical spray configuration and a wash spray configuration.

In particular, when the tapered surface 157 of the chemical control element 150 is operably engaged with the intermediate chamber 115, the wand apparatus is disposed in a wash spray configuration. When the tapered surface 157 of the chemical control element 150 is disengaged with the intermediate chamber 115, the wand apparatus is disposed in a chemical spray configuration. For example, a pressure washing system may include at least a first fluid tank filled with water and a second fluid tank filled with a chemical cleaning solution. Additionally, the system may be configured such that the first fluid tank and/or the second fluid tank is in fluid communication with the wand apparatus 5. Additionally or alternatively, the first fluid tank containing the water may be configured to flow through the hose 32 at a first pressure level. The second fluid tank containing the chemical cleaning solution may be configured to flow through the hose 32 at a second pressure level that is greater than the first pressure level. For example, the second fluid tank may be in fluid communication with the first fluid tank and/or the hose 32 via a chemical injector valve. In particular, when the fluid pressure within the second fluid channel 23 and/or hose 32 is above a particular threshold, the chemical injector valve will be prohibited from providing the hose 32 and/or the wand assembly 5 with the chemical cleaning solution. When the pressure within the second fluid channel 23 and/or hose 32 is below a particular threshold, the chemical injector valve will be able to provide fluid flow through the hose and/or wand assembly so as to provide for the fluid flow of the chemical cleaning solution therethrough.

As such, when the tapered surface 157 of the chemical control element 150 is operably engaged with the intermediate chamber 115, the wand apparatus 5 will be disposed in the wash spray configuration. In particular, the smaller area of the control aperture 153 will cause the fluid pressure in the inlet chamber 135, second fluid channel 23 and/or the hose 32 to increase, thereby causing the chemical injector valve to prohibit flow of the chemical cleaning solution therethrough and allow for the water from the first fluid tank to flow through the hose 32 and the wand apparatus 5. As such, the water from the first fluid tank would flow through the second fluid channel 23, through the inlet chamber 135, through the intermediate chamber 115, through the control aperture 153 and into the pressure control channel 155 and exit out into the chemical control chamber 145 via the first and second flow apertures 154A, 154B of the pressure control member 152.

Likewise, when the tapered surface 157 of the chemical control element 150 is disengaged with the intermediate chamber 115, the wand apparatus will be disposed in the chemical spray configuration. In particular, the greater diameter of the intermediate chamber 115 will cause the fluid pressure in the inlet chamber 135, the second fluid channel 23, and/or the hose 32 to decrease, thereby allowing the chemical injector valve to provide for the flow of the chemical cleaning solution therethrough. As such, the chemical cleaning solution would flow through the second fluid channel 23, through the inlet chamber 135, and through the intermediate chamber 115 directly into the chemical control chamber 145.

Figure 6:
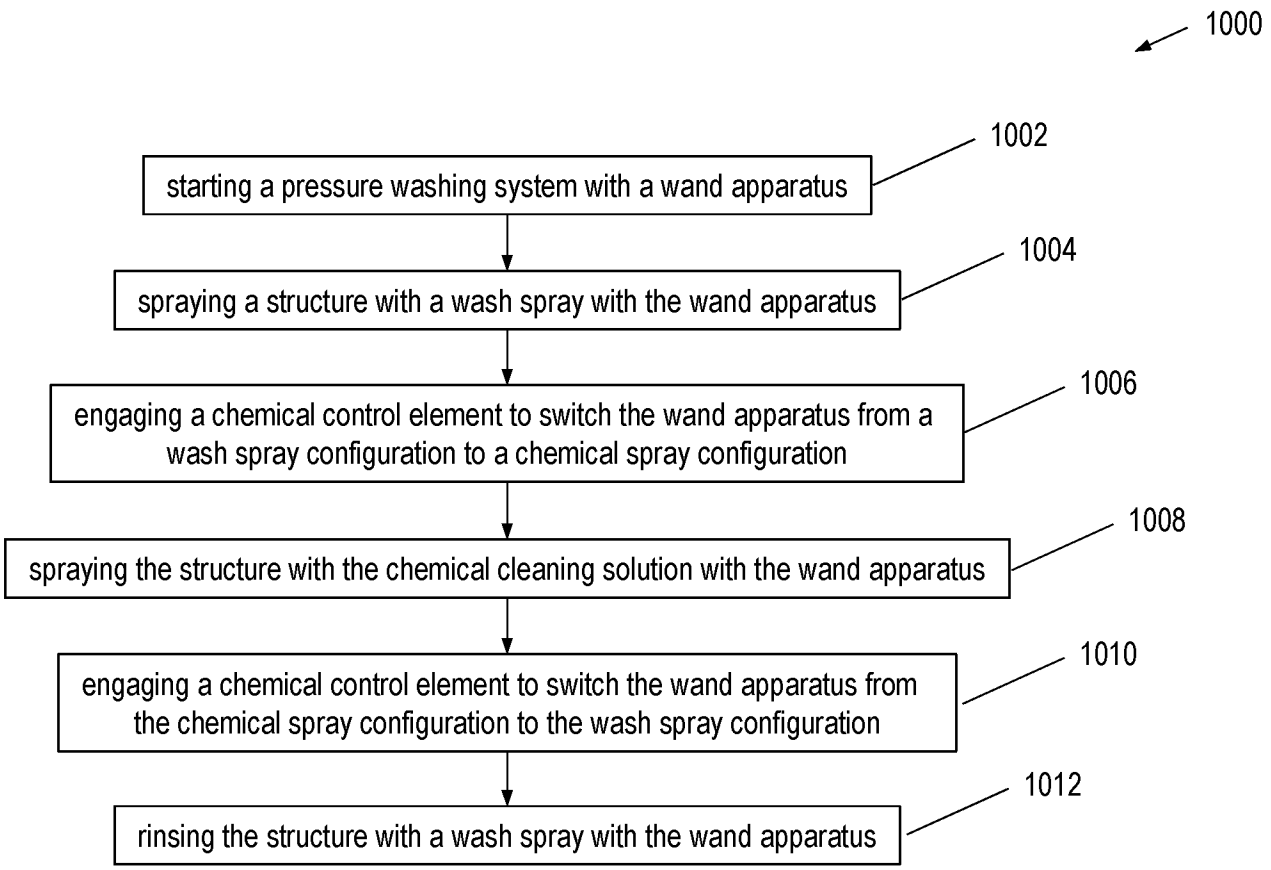
FIG. 6 illustrates a schematic block diagram of a method of using a wand apparatus according to one example implementation of the present disclosure.

As shown in FIG. 6, one exemplary aspect of the present disclosure provides a method 1000 of cleaning a structure with a wand apparatus of a pressure washing system. The method 1000 may include starting a pressure washing system 1002 that includes a wand apparatus, such as those described by the various embodiments disclosed herein. Starting one exemplary and/or suitable pressure washing system may include engaging at least one pump operably engaged with at least one fluid tank containing water. In some aspects, starting a pressure washing system may further include engaging at least one pump operably engaged with a second fluid tank containing a chemical cleaning solution.

The method 1000 may further include spraying the structure with a wash spray with the wand apparatus 1004. For example, the method 1000 may include spraying the structure first with water to sufficiently wet the surface before a chemical cleaning solution is applied to the structure. Once the structure has been wetted satisfactorily, the method 1000 may further include engaging the chemical control element to switch the wand apparatus from a wash spray configuration to a chemical spray configuration 1006. For example, the method may include rotating a stabilizing grip handle such that a pressure control member disengages from an intermediate chamber allowing for the fluid to flow from the intermediate chamber directly into a chemical control chamber. As the pressure in the second fluid channel decreases, the chemical cleaning solution from a second fluid tank may begin to flow through the hose and/or the wand apparatus.

The method 1000 may further include spraying the structure with a chemical cleaning solution and/or a chemical spray with the wand apparatus 1008. Upon cleaning the structure with the chemical cleaning solution, a user may change the type of the fluid back to a wash spray without having to travel back to first and/or second fluid tanks located on, for example, a truck. Rather, the method 1000 further includes engaging the chemical control element to switch the wand apparatus from a chemical spray configuration to a wash spray configuration 1010. In particular, a user may rotate the stabilizing grip handle in an opposing rotation such that the pressure control member operably engages the intermediate chamber thereby increasing the fluid pressure within the second fluid channel and/or the hose. This increase in fluid pressure may cause the chemical cleaning solution from the second fluid tank to cease flowing through the hose and/or the wand apparatus and will allow the water from the first fluid tank to begin flowing through the hose and/or wand apparatus. As such, the method 1000 may end with a user rinsing the structure with a wash spray with the wand apparatus 1012. In particular, the user may rinse the chemical cleaning solution that had previously been applied to the structure with a wash spray consisting primarily of water with the wand apparatus.

Many modifications and other implementations of the disclosure set forth herein will come to mind to one skilled in the art to which the disclosure pertains having the benefit of the teachings presented in the foregoing description and the associated drawings. Therefore, it is to be understood that the disclosure is not to be limited to the specific implementations disclosed and that modifications and other implementations are intended to be included within the scope of the appended claims. Moreover, although the foregoing description and the associated drawings describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

The foregoing description comprises illustrative embodiments. Having thus described example embodiments, it should be noted by those skilled in the art that the within disclosures are example only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A wand apparatus of a pressure washing system, the wand apparatus comprising:

a first wand portion;

a second wand portion; and a chemical control assembly, the chemical control assembly comprising a housing and a chemical control element, wherein the housing defines an outlet aperture, an inlet aperture, and a chemical control aperture, wherein the chemical control aperture is configured to operably engage the chemical control element, wherein the outlet aperture is configured to operably engage the first wand portion, wherein the inlet aperture is configured to operably engage the second wand portion, and wherein the chemical control element is configured to switch the wand apparatus between a chemical spray configuration and a wash spray configuration, wherein the chemical control element further comprises a stabilizing grip handle and a pressure control member, wherein the stabilizing grip handle extends along a plane orthogonal to at least one of the first wand portion and the second wand portion, wherein the pressure control member extends coaxially from the stabilizing grip handle, and wherein the stabilizing grip handle is configured to rotate about a central axis that extends longitudinally along the chemical control element.

2. The wand apparatus of claim 1, wherein the first wand portion defines a first fluid channel extending throughout the first wand portion.

3. The wand apparatus of claim 2, wherein the second wand portion defines a second fluid channel extending throughout the second wand portion.

4. The wand apparatus of claim 3, wherein the first fluid channel is in fluid communication with the outlet aperture of the chemical control assembly and wherein the second fluid channel is in fluid communication with the inlet aperture of the chemical control assembly.

5. The wand apparatus of claim 1, wherein the housing of the chemical control assembly further defines an outlet chamber, an inlet chamber, and a chemical control chamber, wherein the outlet chamber is in fluid communication with the chemical control chamber, and wherein the inlet chamber is in fluid communication with the chemical control chamber.

6. The wand apparatus of claim 5, wherein the pressure control member defines a control aperture, a first flow aperture, and a second flow aperture.

7. The wand apparatus of claim 6, wherein the housing of the chemical control assembly further defines an intermediate flow chamber, the intermediate flow chamber being in fluid communication between the inlet chamber and the chemical control chamber.

8. The wand apparatus of claim 7, wherein an intermediate flow chamber diameter is greater than a control aperture diameter of the pressure control member of the chemical control element.

9. The wand apparatus of claim 8, wherein rotation of the chemical control element causes the pressure control member to operably engage the intermediate flow chamber defined by the housing of the chemical control element.

10. The wand apparatus of claim 1 further comprising a trigger assembly, the trigger assembly configured to provide for a fluid flow through the wand apparatus.

* * * * *